US005139235A

United States Patent [19]

Kilmer

[11] Patent Number: 5,139,235

[45] Date of Patent: Aug. 18, 1992

[54] CORNER FENCE POST SYSTEM

[76] Inventor: Willis G. Kilmer, 4730 Antioch, Merriam, Kans. 66203

[21] Appl. No.: 736,598

[22] Filed: Jul. 26, 1991

[51] Int. Cl.[5] ..... B21F 27/00

[52] U.S. Cl. ..... 256/36; 256/35; 52/157

[58] Field of Search ..... 52/157, 154, 151, 146; 256/36, 35

[56] References Cited

U.S. PATENT DOCUMENTS

| | | | |
|---|---|---|---|
| 299,770 | 6/1884 | Fischer | 256/35 |
| 598,003 | 1/1898 | Oliver | 52/157 X |
| 1,764,207 | 6/1930 | Johnson | 52/154 X |
| 1,911,483 | 5/1933 | Thompson | 52/154 X |
| 3,011,598 | 12/1961 | Galloway et al. | 52/157 X |
| 4,803,812 | 2/1989 | Alexander | 52/157 |
| 4,923,165 | 5/1990 | Cockman | 52/157 X |

*Primary Examiner*—Andrew V. Kundrat

*Attorney, Agent, or Firm*—Hovey, Williams, Timmons & Collins

[57] ABSTRACT

An improved fence post system 10 permits insertion of a fence post 12 into the earth and attachment of a support brace without the use of tools. A fence post unit 12 includes an augered base 16, a removable extension piece 14 and a bracket 18. The bracket 18 may be used alternately to support a handlepiece which is rotated in order to auger the post into the ground, and to couple a support brace. Several units may be coupled to form a corner fence post. The base unit is equipped with a stabilizer device 38 for lateral support.

19 Claims, 2 Drawing Sheets

CORNER FENCE POST SYSTEM

BACKGROUND OF THE INVENTION

1. Field of the Invention

The present invention is broadly concerned with an improved fence post system which permits insertion of a fence post into the earth and installation of a support brace without the use of tools. More particularly, it is concerned with a corner fence post having an augered base, a removable extension piece and a bracket. The bracket may be used alternately to support a handlepiece which is rotated in order to auger the post into the ground, and to couple a support brace.

2. Description of the Prior Art

The installation of fence posts has always been a difficult, tedious job requiring specialized tools and back breaking labor. Since the available power machinery is unwieldy and prohibitively expensive for most applications, installation methods such as digging or driving have most commonly been employed.

Post holes are generally dug using one of several hand digging implements to dig out a hole into which a fence post is then inserted. Because conventional posts provide no intrinsic lateral support, the hole must be relatively deep in proportion to the above-ground height of the installed post. Earth removed from the hole during digging is subsequently repacked around the installed post. Posts installed by this method are subject to lateral instability until the elements cause the earth to settle around the post. The earth generally sinks somewhat upon settling, forming a depression around the post which may collect water and subject the post to rot and damage caused by insects attracted to damp conditions. While an anchoring element may be installed adjacent the post to provide lateral support, a substantially larger hole must be dug to accommodate the element.

Alternatively, a ram or driver weighted with a material such as lead or cement may be used to pound the post directly into the ground without first making a hole. Because of the weight of the driver and the requirement that the force of the driver be applied to the uppermost end of the post, this method is limited in its application to posts of certain lengths and is not suitable for installation of posts having ornamental tops. This method is also not suitable for driving posts having large diameters or irregular shapes which might split under pounding, such as the hedgeposts commonly employed in farming and ranching. While there is no easy method for installation of posts in hard clay or rocky soils, driving the post is an especially burdensome task under such conditions.

Previous attempts to facilitate fence post installation by providing an auger type post have employed posts which are structurally complex and prohibitively expensive. Such posts have been of metal construction, which is not well adapted for electrical applications. In addition, specialized tools are required for installation.

SUMMARY OF THE INVENTION

The present invention overcomes the problems outlined above and provides a greatly improved fence post system which permits insertion of a fence post into the earth and installation of a support brace without requiring the use of tools. Broadly speaking, the fence post includes an augered base portion removably coupled with an extension portion, and a bracket. The multifunctional bracket may be used alternately to support a handlepiece which is used to rotate the post in order to auger the base into the ground, and to couple a support brace which is likewise inserted into the ground. The parts of fence post units are interchangeable, so that the extension portion of a first unit may be used as a handlepiece to auger a second unit.

Advantageously, the base portion includes a single auger flight and an extension piece from a second post unit is employed as a handlepiece for rotating the first post in order to auger its base portion into the ground. In particularly preferred forms, the base further includes fins which are inserted into the earth above the auger flight for imparting lateral stability.

DESCRIPTION OF THE PREFERRED EMBODIMENT

Figures 1, 2:
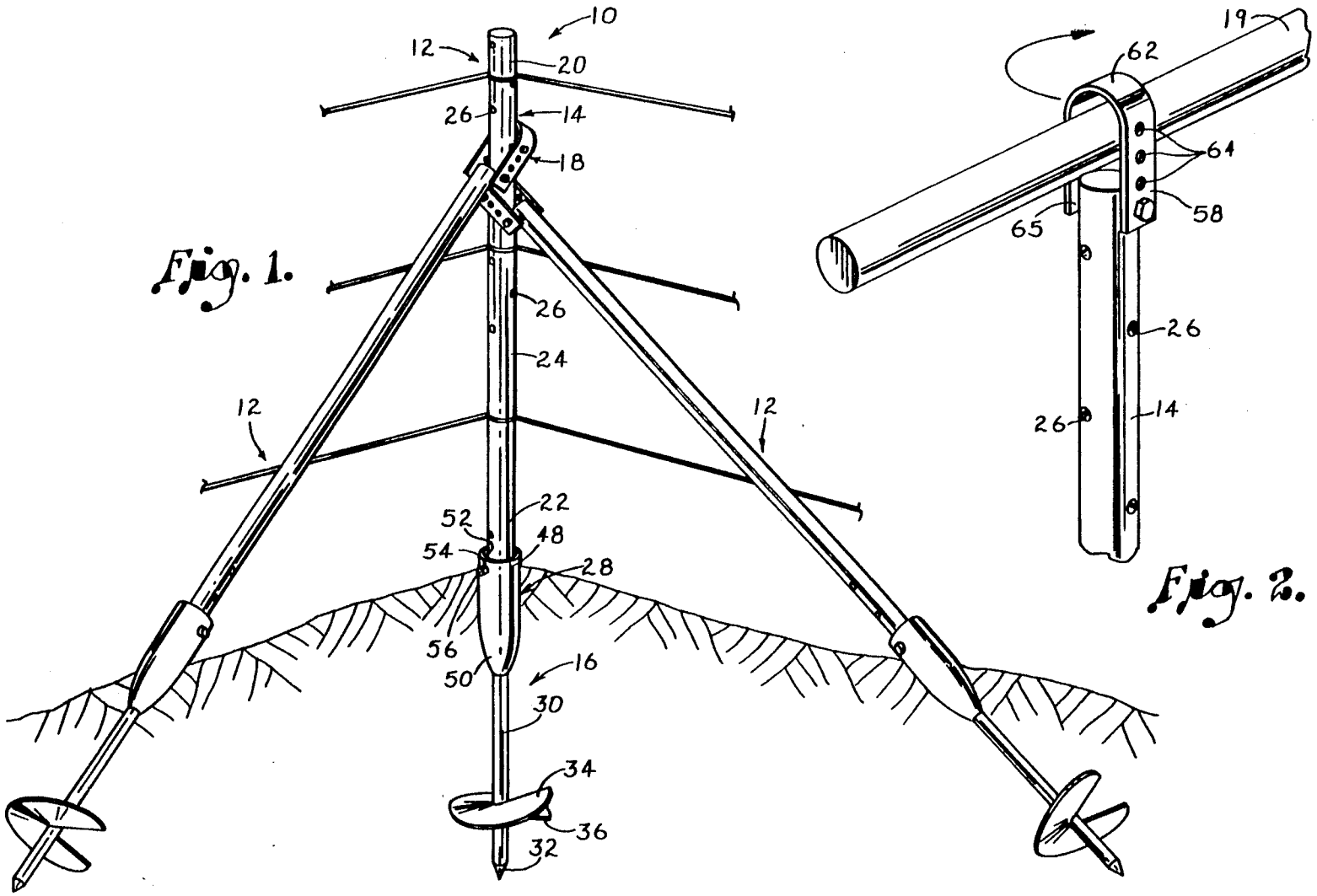
FIG. 1 is a front perspective view of a corner fence post system in accordance with the invention.
FIG. 2 is a fragmentary perspective view of the top portion of the post shown in FIG. 1 showing a bracket coupled with the post for supporting a handlepiece.
Figure 3:
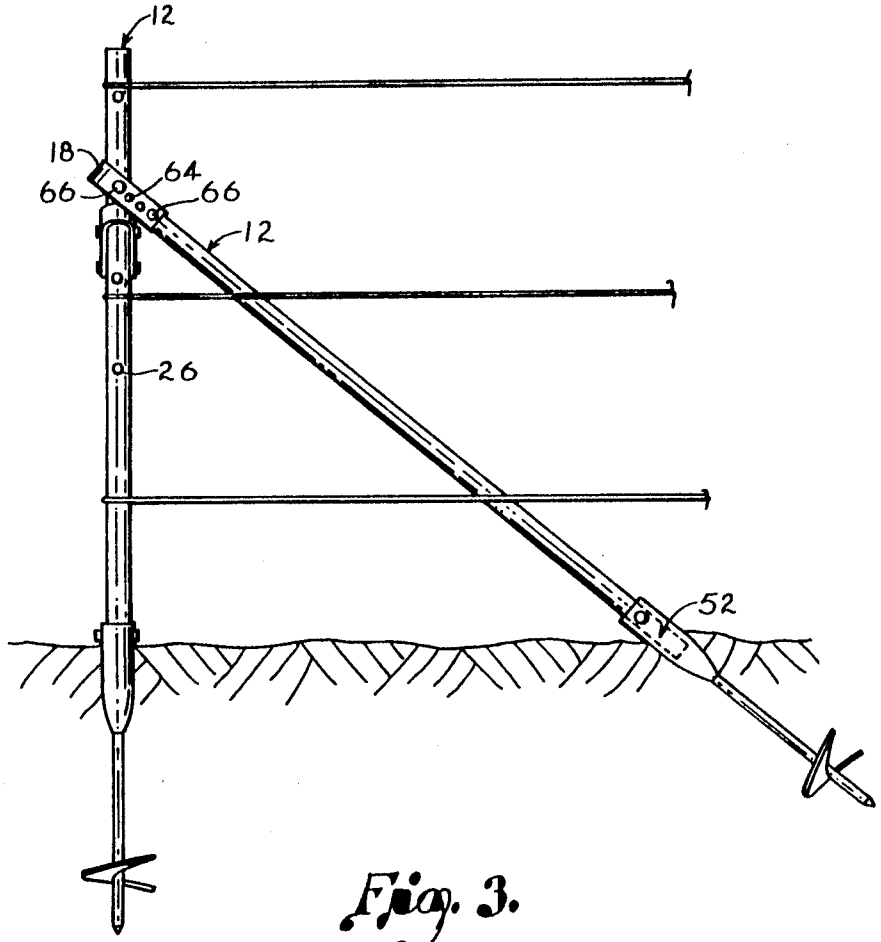
FIG. 3 is a side elevational view of a post system similar to that shown in FIG. 1 having a single support brace with certain parts shown in phantom.

Referring now to the drawings, a corner fence post system 10 in accordance with the invention is shown in FIG. 1 to include a total of three fence post units 12, each including an extension portion 14, a base 16, and clamp 18. Those skilled in the art will appreciate that the fence post unit of the invention may used singly, with one or more ground contacting braces as shown in FIGS. 1 and 3, or with one or more generally horizontal braces which in turn are coupled with another upright object such as a fence post unit or wall.

In more detail, elongated cylindrical extention 14 includes upper end portion 20, lower end portion 22 and central section 24. Apertures 26 extend through the diameter of extension 14 at staggered spaced intervals. The extension members are advantageously constructed of sturdy, electrically insulating material, preferably fiberglass ⅛ to 1 and ¼ inch in diameter for use in electric fencing systems, although wood or metals such as steel or wrought iron may also be employed.

As shown in FIGS. 1 and 3–5, metal base 16 includes tubular element 28 integrally coupled with shaft 30, which terminates at lowermost end 32. Terminal end 32 is preferably beveled to facilitate insertion into the earth. An auger flight 34, consisting of a single 360° convolution, is coupled with shaft 30 in spaced relationship with end 32. In preferred embodiments flight 34 is constructed of steel, presents a diameter of about 3 to 5 inches and includes a bevel 36 to facilitate advancement of the flight into the earth. Tubular element 28 is constructed of a 5 to 7 inch length of 1 to 2 inch inner diameter steel pipe drawn together at closed end 50. Shaft 30 is formed from a 10 to 12 inch section of ½ inch steel rod and ia advantageously coupled to auger flight 34 and tubular element 28 by welding.

Figure 5:
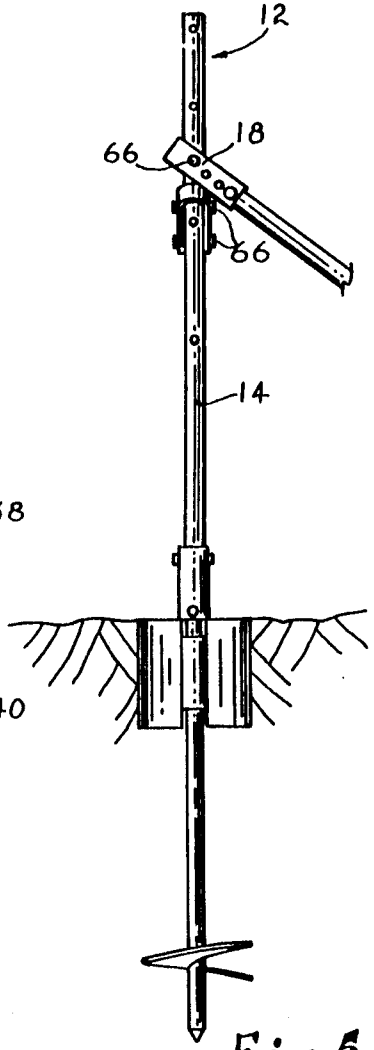
FIG. 5 is a side elevational view of the device of FIG. 4 installed in the earth with support braces and with parts broken away.
Figure 4:
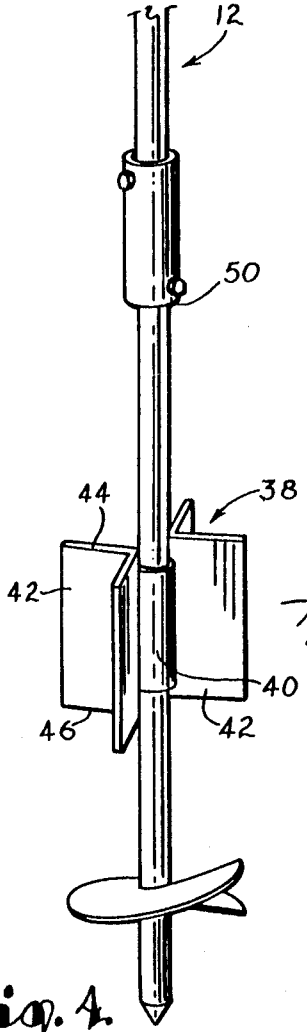
FIG. 4 is a fragmentary front perspective view of an alternate fence post unit having stabilizer means.

As shown in FIGS. 4 and 5, certain preferred embodiments include a stabilizer device 38 having a tubular central sleeve 40 axially shiftable along shaft 30 coupled with a series of vertically oriented, rectangular fins 42 presenting upper and lowermost surfaces 44, 46. Stabilizer 38 is advantageously constructed of a pair of 3 inch angle iron pieces about 4–8 inches in length attached by welding or other means to a tubular steel sleeve having an inner diameter of about ½ to one inch.

Tubular element 28 presents an open end portion 48 and a closed end portion 50, the open end 48 defining an axial recess 52 for receiving extension 14. Open end 48 is provided with a pair of opposed apertures 54 for axial alignment with extension apertures 22 and for receiving a bolt 56 therein. Closed end portion 50 is coupled with shaft 30 by welding or other suitable means.

As best shown in FIG. 2, generally U-shaped clamp 18 includes a pair of opposed legs 58, 60 having a bight portion 62 therebetween. Legs 58, 60 further include a series of spaced apertures 64 for alignment with extension apertures 26 for receiving a bolt 66 therebetween.

In use, clamp member 18 and extension piece 14 cooperatively serve as a tool for the installation of fence post unit 10. A user couples clamp member 18 with upper extension portion 20 and inserts an extension piece 14 taken from another fence post unit therethrough. Any other suitable handlepiece may also be employed. The user next rotates the handlepiece thus turning the attached extension and base unit in order to auger the post unit into the earth.

Clamp member 18 is coupled with extension portion 14 by aligning clamp apertures 64 with extension apertures 26 and inserting bolt 66 therethrough. Bolt 66 may be held in place by a nut or may be sized to thread into aperture 64. In other preferred installation methods, clamp 18 may be coupled directly to base 16 by means of apertures 54. Once clamp 18 is installed, extension 14 or any suitable handlepiece may be slipped under the bight portion 62 to couple the handlepiece with the post unit 12. A user grasps the handlepiece and rotates it in a direction corresponding to the handedness of auger flight 34. Advancement of auger 32 through the earth pulls base 16 into the earth as well.

Installation of a fence post unit by this method is substantially less disturbing to the soil than convention methods in which a hole is dug and soil is removed, or even methods employing a multiflighted auger. Consequently, the soil remains more firmly packed against the post for lateral support.

In the preferred embodiment illustrated in FIG. 1, a second post unit is installed as a brace at an angular relationship to the first post by the method previously described. The extension units 14 of the first and second post unit 12 are coupled by inserting the first extension through the bight portion of clamp 18. Additional clamp apertures 64 are aligned with apertures 26 located in the first post extension 14, and a bolt 66 is inserted therethrough to prevent relative movement of the clamp 18.

Where the initial post unit serves as a corner post, a third post unit may be installed in like manner as a second brace, in generally triangular relationship with the first and second post units.

In still other preferred embodiments as shown in FIGS. 4 and 5, a stabilizer device 38 is shiftably coupled with the shaft 30 of base unit 16. Advancement of auger flight 34 into the earth pulls shaft 30 through central sleeve 40 until the lowermost surface of fins 42 is brought into contact with the earth. Upon further advancement of the flight, the fins 42 may be pressed into the loosened earth above flight 34 by a the foot of a user. Rotation of the flight is continued until closed end 50 rests atop the uppermost surface 44 of vertical fins 46 and installation is complete.

Those skilled in the art will appreciate that the present invention encompasses many variations in the preferred embodiment described herein. For example, for electrical applications extension members 14 may be constructed of polyvinylchloride; a metal extension may be employed which is provided with insulators; or the post unit may be used for non-electrical applications such as barbed wire. For ornamental applications, base 16 may be constructed of lighter materials such as aluminum or fiberglass.

Having described the preferred embodiments of the present invention, the following is claimed as new and desired to be secured by Letters Patent:

1. A fence post apparatus comprising:

a fence post having an auger flight near the lower end thereof; and coupling means for coupling said posts in a supporting relationship with a support brace, and for coupling said post with a handlepiece in a configuration for allowing use of said handlepiece for rotating said post and thereby said flight for augering said post into the earth, wherein said fence post apparatus further includes:

first and second fence posts, each provided with a base portion removably coupled with an extension portion with each portion presenting an upper end, said base portion having an auger flight; and bracket means for coupling said first post in a supporting relationship with a support brace, and alternately for coupling with one of said first post upper ends for supporting one of said extension pieces in a generally transverse relationship with said first post for allowing rotation of said piece and thereby said post for augering at least said base portion into the earth.

2. A fence post apparatus comprising:

a fence post having an auger flight near the lower end thereof; and coupling means for coupling said posts in a supporting relationship with a support brace, and for coupling said post with a handlepiece in a configuration for allowing use of said handlepiece for rotating said post and thereby said flight for augering said post into the earth, wherein said fence post further includes a base portion coupled with an extension portion, said extension portion being constructed of a sturdy, electrically insulating material.

3. The apparatus as set forth in claim 2, wherein said electrically insulating material further includes fiberglass.

4. The apparatus as set forth in claim 1, wherein said fence post further includes a base portion coupled with an extension portion, said base portion including stabilizer means for insertion into the earth above said auger flight for imparting lateral stability to said base.

5. The apparatus as set forth in claim 4, wherein said stabilizer means includes at least two vertically oriented opposed fins.

6. The apparatus as set forth in claim 1, wherein said auger flight further includes a single, 360° convolution.

7. The apparatus as set forth in claim 4, wherein said coupling means further includes a tubular element coupled with said auger flight, and attachment means for connecting said tubular element in mating engagement with said extension portion.

8. A fence post apparatus comprising;

a fence post having an auger flight near the lower end thereof; and coupling means for coupling said post in a supporting relationship with a support brace, and for coupling said post with a handlepiece in a configuration for allowing use of said handlepiece for rotating said post and thereby said flight for augering said post into the earth, wherein said coupling means further includes a generally U-shaped clamp member having attachment means for connecting said clamp member to said post.

9. A method for installing a fence post comprising:

providing a fence post having an auger flight near the lower end thereof;

coupling a handlepiece with the post and using said handlepiece to rotate the post and thereby said flight for augering said post into the earth; and coupling a support brace to the post for supporting said fence post, wherein said method further includes the steps of:

providing first and second fence posts, said first post being upright, each including a base portion removably coupled with an extension portion with each portion presenting an upper end, said base portion having an auger flight;

coupling one of said extension pieces with one of said first post upper ends in a generally transverse relationship for allowing rotation of said piece and thereby said post for augering at least said base portion into the earth; and coupling a support brace at an angle with said first post in a supporting relationship.

10. The method of claim 9, wherein said fence post includes vertically shiftable stabilizer means and wherein following said augering step is further included the step of inserting said stabilizer means into the earth above said auger flight for imparting lateral stability to said fence post.

11. The method of claim 9, wherein said support brace is the extension piece of said second post.

12. The method of claim 9 wherein said method further includes the steps of providing and coupling a third fence post at an angle in supporting relationship with said first post.

13. The apparatus as set forth in claim 2, wherein said fence post further includes a base portion coupled with an extension portion, said base portion including stabilizer means for insertion into the earth above said auger flight for imparting lateral stability to said base.

14. The apparatus as set forth in claim 13, wherein said stabilizer means includes at least two vertically oriented opposed fins.

15. The apparatus as set forth in claim 2, wherein said auger flight further includes a single, 360° convolution.

16. The apparatus as set forth in claim 13, wherein said coupling means further includes a tubular element coupled with said auger flight, and attachment means for connecting said tubular element in mating engagement with said extension portion.

17. The apparatus as set forth in claim 8, wherein said fence post further includes a base portion coupled with an extension portion, said base portion including stabilizer means for insertion into the earth above said auger flight for imparting lateral stability to said base.

18. The apparatus as set forth in claim 17, wherein said stabilizer means includes at least two vertically oriented opposed fins.

19. The apparatus as set forth in claim 8, wherein said auger flight further includes a single, 360° convolution.

* * * * *